US010562072B2

(12) United States Patent
Ozeki et al.

(10) Patent No.: US 10,562,072 B2
(45) Date of Patent: Feb. 18, 2020

(54) GRIZZLY APPARATUS AND BOTTOM ASH DISCHARGE SYSTEM

(71) Applicant: KAWASAKI JUKOGYO KABUSHIKI KAISHA, Kobe-shi, Hyogo (JP)

(72) Inventors: Yasutaka Ozeki, Kobe (JP); Yoshihiko Takemura, Kobe (JP); Tomoyuki Suzuki, Kobe (JP); Kei Takakura, Kobe (JP); Hiroshi Ito, Kobe (JP); Keiichi Mashio, Amagasaki (JP); Hiroshi Aoyagi, Amagasaki (JP); Takeshi Kawana, Kobe (JP); Akira Yamashita, Kobe (JP); Ryutaro Okada, Kobe (JP); Keita Tsunemori, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/065,828

(22) PCT Filed: Dec. 2, 2016

(86) PCT No.: PCT/JP2016/005049
§ 371 (c)(1),
(2) Date: Jun. 25, 2018

(87) PCT Pub. No.: WO2017/110051
PCT Pub. Date: Jun. 29, 2017

(65) Prior Publication Data

US 2019/0009303 A1 Jan. 10, 2019

(30) Foreign Application Priority Data

Dec. 25, 2015 (JP) ..... 2015-253123

(51) Int. Cl.
*B07B 13/16* (2006.01)
*B07B 1/12* (2006.01)
(Continued)

(52) U.S. Cl.
CPC ..... *B07B 1/12* (2013.01); *B07B 1/14* (2013.01); *B07B 1/145* (2013.01); *B07B 1/46* (2013.01);
(Continued)

(58) Field of Classification Search
CPC .. B07B 1/12; B07B 1/14; B07B 1/145; B07B 1/15; B07B 1/46; B07B 1/4609; B07B 11/06; F23J 1/00
(Continued)

(56) References Cited

U.S. PATENT DOCUMENTS 2,743,813 A * 5/1956 Erickson ..... B07B 1/15 184/7.2
3,113,574 A * 12/1963 Greedy ..... A01F 11/06 198/442
(Continued)

FOREIGN PATENT DOCUMENTS

DE 1228212 B 11/1966
DE 2140371 A1 2/1973
(Continued)

OTHER PUBLICATIONS

Sep. 13, 2019 Extended Search Report issued in European Patent Application No. 16877956.9.

*Primary Examiner* — Joseph C Rodriguez
(74) *Attorney, Agent, or Firm* — Oliff PLC

(57) ABSTRACT

A grizzly apparatus includes a plurality of grizzly bars arranged at predetermined intervals in a second direction perpendicular to a first direction which is an extension direction of center axes of the grizzly bars. Each of the
(Continued)

plurality of grizzly bars is rotatable in a direction opposite to a direction of rotation of its adjacent grizzly bar so that a slit through which a screening target object passes and a gap through which the screening target object does not pass alternately emerge, between adjacent grizzly bars. The guide includes an outer member forming its outer shape, and has at least one guide surface inclined with respect to the second direction in such a way that the guide surface descends as the guide surface advances in the second direction toward the slit to guide the screening target object having fallen onto the guide to the slit.

12 Claims, 7 Drawing Sheets

(51) Int. Cl.

| | |
|---|---|
| ***B07B 13/07*** | (2006.01) |
| ***F23J 1/00*** | (2006.01) |
| ***B07B 1/46*** | (2006.01) |
| ***B07B 1/14*** | (2006.01) |
| *B07B 1/42* | (2006.01) |

(52) U.S. Cl.
CPC ..... *B07B 13/07* (2013.01); *B07B 13/16* (2013.01); *F23J 1/00* (2013.01); *B07B 1/42* (2013.01)

(58) Field of Classification Search
USPC ..... 209/243, 244, 248, 249
See application file for complete search history.

(56) References Cited

U.S. PATENT DOCUMENTS

| | | | | | |
|---|---|---|---|---|---|
| 3,250,277 | A | * | 5/1966 | Garriott | A01F 11/06 198/582 |
| 3,283,895 | A | * | 11/1966 | Rollins | A01D 33/08 198/625 |
| 3,848,744 | A | | 11/1974 | Flaherty | |
| 3,900,036 | A | * | 8/1975 | Anderson | A01F 11/06 460/29 |
| 4,396,503 | A | * | 8/1983 | Schmidt | B05C 21/00 118/406 |
| 4,600,106 | A | | 7/1986 | Minardi | |
| 4,804,147 | A | * | 2/1989 | Hooper | B03B 9/04 106/DIG. 1 |
| 5,175,906 | A | * | 1/1993 | Holter | B07B 1/145 15/3.1 |
| 5,373,947 | A | * | 12/1994 | Nakamura | B07B 1/145 209/618 |
| 5,495,948 | A | * | 3/1996 | Ishida | B03B 9/04 209/11 |
| 7,607,544 | B2 | * | 10/2009 | Petersen | B07C 5/3422 209/44.1 |

FOREIGN PATENT DOCUMENTS

| | | | |
|---|---|---|---|
| FR | 2545385 | A1 | 11/1984 |
| GB | 2239157 | A | 6/1991 |
| JP | S55-76048 | U | 5/1980 |
| JP | H04-91773 | U | 8/1992 |
| JP | H05-139522 | A | 6/1993 |
| JP | 2005-233563 | A | 9/2005 |
| JP | 2013-230435 | A | 11/2013 |

* cited by examiner

GRIZZLY APPARATUS AND BOTTOM ASH DISCHARGE SYSTEM

TECHNICAL FIELD

The present invention relates to a grizzly apparatus and a bottom ash discharge system including the grizzly apparatus.

BACKGROUND ART

Conventionally, in an ore sorting factory or a stone crushing factory, a screen called a grizzly apparatus is used to remove mud from raw stone and deliver the raw stone which is free from mud to a hopper. Typically, the grizzly apparatus includes a plurality of grizzly bars arranged in parallel at predetermined intervals corresponding to screen openings and disposed with an inclination angle of 35 to 45 degrees with respect to a horizontal direction. Patent Literature 1 discloses such a grizzly apparatus.

The grizzly apparatus disclosed in Patent Literature 1 includes a plurality of rollers arranged in parallel at predetermined intervals at a feeding part of a raw stone hopper, and a plurality of separators disposed above the rollers. Two adjacent rollers of the plurality of rollers form a pair. The pair of rollers are driven to rotate in opposite directions. Between the pair of rollers, a slit used to sort out the raw stone is formed. Between two adjacent pairs of rollers, a gap is formed. The separator is disposed to cover the gap formed between two adjacent pairs of rollers, and has a shape in which a rectangular plate is folded in two to form an upwardly protruding part. This separator serves to guide the raw stone to the slit formed between the pair of rollers.

CITATION LIST

Patent Literature

Patent Literature 1: Japanese Laid-Open Patent Application Publication No. Hei. 5-139522

SUMMARY OF INVENTION

Technical Problem

An object of the present invention is to provide a grizzly apparatus which is suitably used to separate a huge ash mass (huge ash lump) from ash (bottom ash) having fallen onto a furnace bottom of a furnace, and a bottom ash discharge system including the grizzly apparatus.

Solution to Problem

Conventionally, a coal burning boiler including a furnace which combusts crushed pieces of coal is known. Some of particles of coal combustion ash generated in the furnace of the boiler melt and clump together to form porous masses or lumps, which fall onto the furnace bottom. The bottom ash having fallen onto the furnace bottom is discharged to an outside region by a conveyor device of a dry or wet type.

If the coal combustion ash melting in the boiler furnace adheres to, for example, a heat transfer pipe provided inside the furnace, or a wall of the furnace, this is grown and solidified into a very large ash mass (huge ash mass or huge ash lump). If the large ash mass is grown to have a relatively large size, this large ash mass may fall due to its weight, a vibration, or the like. In a case where such a large ash mass is transported by a conveyor device, the conveyor device is required to have a resistance to an impact generated when the large ash mass falls onto the conveyor device and a width sufficient to transport the large ash mass, which increases cost and size of the conveyor device.

In view of the above, inventors considered that the huge ash mass (huge ash lump) is separated from bottom ash and the bottom ash which is free from the huge ash mass is transported by a conveyor. To realize this, the inventors developed a grizzly apparatus which is suitably used to separate the huge ash mass from the bottom ash having fallen onto a furnace bottom based on techniques of the grizzly apparatus which has been conventionally used in the arts of ore sorting and stone crushing.

According to an aspect of the present invention, there is provided a grizzly apparatus comprising: a plurality of grizzly bars disposed in such a manner that an extension direction of center axes of the plurality of grizzly bars is parallel to a first direction, the plurality of grizzly bars being arranged at predetermined intervals in a second direction perpendicular to the first direction; and at least one guide provided above the plurality of grizzly bars and extending in the first direction, wherein each of the plurality of grizzly bars is rotatable in a direction opposite to a direction of rotation of its adjacent grizzly bar so that a slit through which a screening target object passes and a gap through which the screening target object does not pass alternately emerge, between adjacent grizzly bars, the slit being formed between peripheral surfaces rotating in an upward direction, of the adjacent grizzly bars, wherein the at least one guide is solid and has at least one guide surface inclined with respect to the second direction in such a way that the guide surface descends as the guide surface advances in the second direction toward the slit to guide the screening target object having fallen onto the guide to the slit. In the grizzly apparatus and bottom ash discharge system described above, the at least one guide may include an outer member forming an outer shape of the guide, and a reinforcement member provided in a space formed by the outer member and allowing the outer member to have a stiffness for keeping its shape.

According to an aspect of the present invention, there is provided a bottom ash discharge system configured to discharge bottom ash having fallen onto a furnace bottom of a furnace, from the furnace bottom to an outside region, the bottom ash discharge system comprising: a housing provided with an entrance through which the bottom ash is fed to an inside of the housing, a discharge port through which a large mass of the bottom ash which has a size larger than a predetermined size is discharged, and an exit through which the bottom ash containing no large mass is discharged; and the grizzly apparatus provided in a passage of the bottom ash from the entrance of the housing to the exit of the housing, and configured to separate the large mass from the bottom ash.

In the grizzly apparatus with the above-described configuration, the guide provided above the grizzly bars can prevent a situation in which a huge ash mass (huge ash lump) contained in a screening target object (object to be screened) having fallen toward the grizzly bar directly hits the grizzly bar. The reinforcement member allows the guide to have a stiffness for suppressing a deformation of the outer member. In this structure, the guide has a strength to withstand an impact generated by a direct hit of the huge ash mass. In this way, the grizzly apparatus is able to withstand an impact generated by the huge ash mass falling from the furnace onto the grizzly apparatus, together with the bottom ash, and to separate the huge ash mass from the bottom ash. Therefore, the above-described grizzly apparatus is suitably used to separate the huge ash mass from the bottom ash having fallen onto the furnace bottom of the furnace.

In the grizzly apparatus and bottom ash discharge system described above, the reinforcement member may include a filling material filled in the space formed by the outer member.

The guide filled with the reinforcement member has a solid structure. In this structure, the guide has a strength to withstand an impact generated by a direct hit of the large ash mass.

In the grizzly apparatus and bottom ash discharge system described above, the outer member may include an outermost layer portion made of a fireproof material.

In this configuration, the guide can have a fireproof capability. Since the guide has the fireproof capability, the above-described grizzly apparatus is suitably used to separate the huge ash mass from the bottom ash having fallen onto the furnace bottom of the furnace.

In the grizzly apparatus and bottom ash discharge system described above, the outer member may include an intermediate layer portion made of a heat insulating material.

In this configuration, the guide can have a heat resistance. Since the guide has the heat resistance, the above-described grizzly apparatus is suitably used to separate the huge ash mass from the bottom ash having fallen onto the furnace bottom of the furnace.

In the grizzly apparatus and bottom ash discharge system described above, each of the plurality of guides may have a width in the second direction, from an end of the gap to a center axis of the grizzly bar forming the gap.

In this configuration, since the guide covers from above a region from the end of the gap to the center axis of the grizzly bar forming the gap, it becomes possible to inhibit entry of the screening target object into the gap in which the screening target object may be stuck, and to guide the screening target object falling toward the gap to the slit.

In the grizzly apparatus and bottom ash discharge system described above, at least one of the plurality of grizzly bars may include a roller having an outer peripheral surface formed with a spiral protruding part which advances in the first direction and is wound around the outer peripheral surface in the same direction as a rotation direction of the at least one grizzly bar.

In this configuration, the protruding part of the roller rotating acts on the screening target object so that the screening target object present in the slit can be pushed up more effectively.

In the grizzly apparatus and bottom ash discharge system described above, the grizzly apparatus may further comprise a frame into which the plurality of grizzly bars are inserted; and a plurality of shaft seal devices each of which is configured to seal a space formed between the frame and corresponding one of the plurality of grizzly bars, and each of the plurality of grizzly bars may be insertable into and disengageable from the frame in the first direction, together with corresponding one of the plurality of shaft seal devices.

In this configuration, since the grizzly bar can be mounted on and detached from the frame together with the shaft seal device, a work for changing (replacing) the grizzly bar can be easily performed.

In the grizzly apparatus and bottom ash discharge system described above, the guide of the grizzly apparatus may be supported by a beam provided at the frame at a location that is above the plurality of grizzly bars, and the beam may have a width in the second direction, from an end of the gap to a center axis of the grizzly bar forming the gap.

In this configuration, it becomes possible to form a constricted (narrowed) space between the beam and the grizzly bar to inhibit entry of the screening target object rotating with the rotation of the grizzly bar, into the gap.

To allow the screening target object to smoothly roll over the grizzly apparatus, the extension direction of the center axes of the grizzly bars is preferably inclined at an angle of 45 to 55 degrees or more. However, if the inclination in the extension direction of the center axes of the grizzly bars is increased, a vertical level to which the grizzly bars are raised is increased during a work for changing (replacing) the grizzly bars. In some cases, the grizzly bars cannot have a proper inclination for allowing the screening target object to smoothly roll over the grizzly apparatus, depending on a situation in which the grizzly apparatus is installed.

In view of this, in the grizzly apparatus and bottom ash discharge system described above, the guide may have a ridge line which is inclined with respect to the first direction in such a way that the ridge line descends as the ridge line advances to a first side in the first direction.

The guide may have at least one inclined surface which is inclined with respect to the first direction in such a way that the inclined surface descends as the inclined surface advances to a first side in the first direction.

For example, the guide may have a pyramid shape in which an end portion on a second side in the first direction is an apex.

In the above-described grizzly apparatus, the extension direction of the center axes of the grizzly bars is parallel to the first direction, and the ridge line of the guide is inclined with respect to the first direction. This allows the ridge line of the guide to be inclined with respect to the horizontal direction at an angle larger than an angle at which the grizzly bars are inclined with respect to the horizontal direction. By adjusting the inclination of the ridge line of the guide with respect to the first direction, the grizzly apparatus can have a proper inclination for allowing the screening target object to smoothly roll over the grizzly apparatus. In this way, the guide allows the grizzly apparatus to have a required inclination while reducing the inclination of the grizzly bars with respect to the horizontal direction.

Advantageous Effects of Invention

The present invention can provide a grizzly apparatus which is suitably used to separate a huge ash mass from bottom ash having fallen onto a furnace bottom of a furnace and a bottom ash discharge system including the grizzly apparatus.

DESCRIPTION OF EMBODIMENTS

[Grizzly Apparatus]

Figure 1:
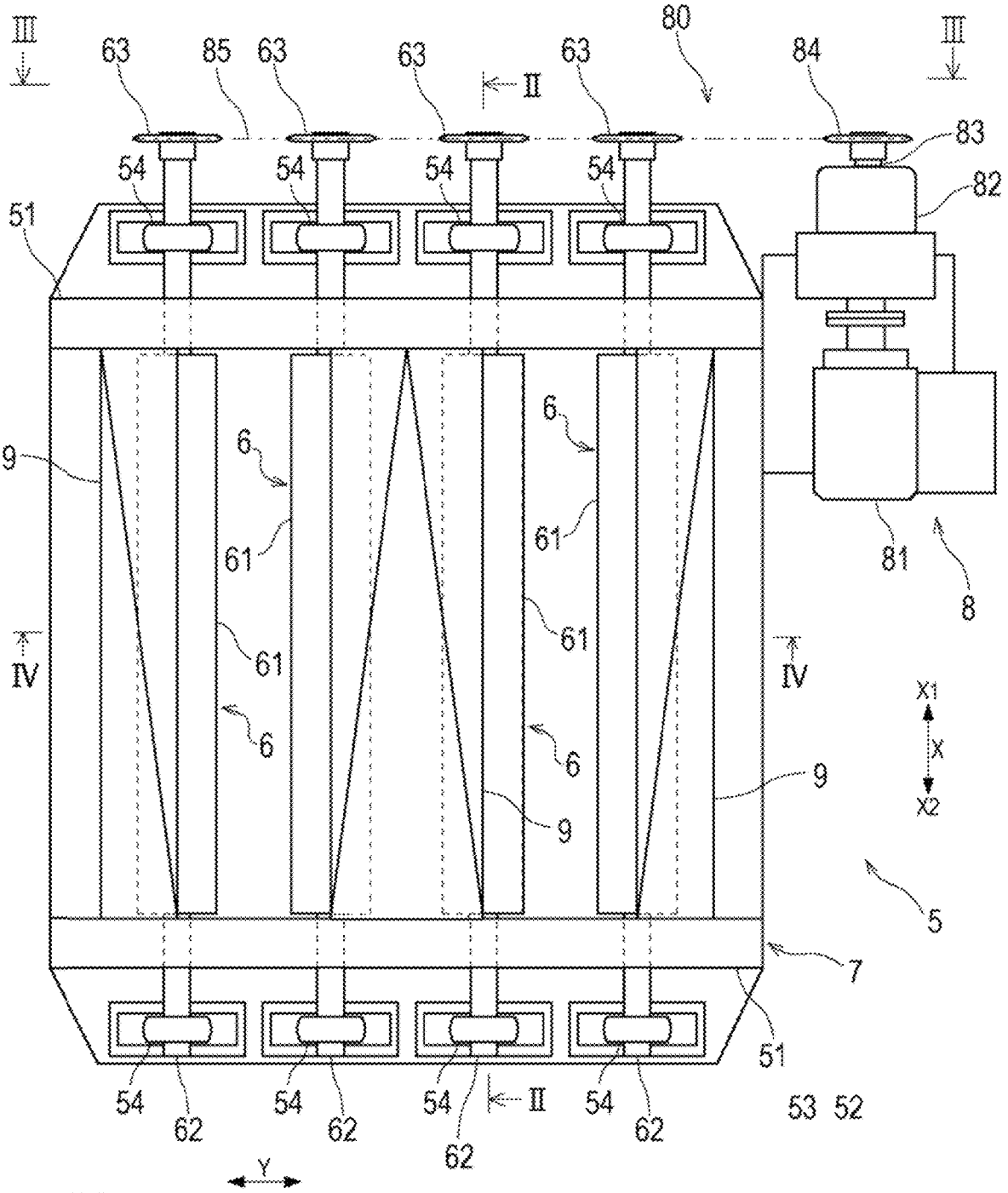
FIG. 1 is a plan view of a grizzly apparatus according to an embodiment of the present invention, in a state in which an extension direction of center axes of grizzly bars is a horizontal direction.
Figure 2:
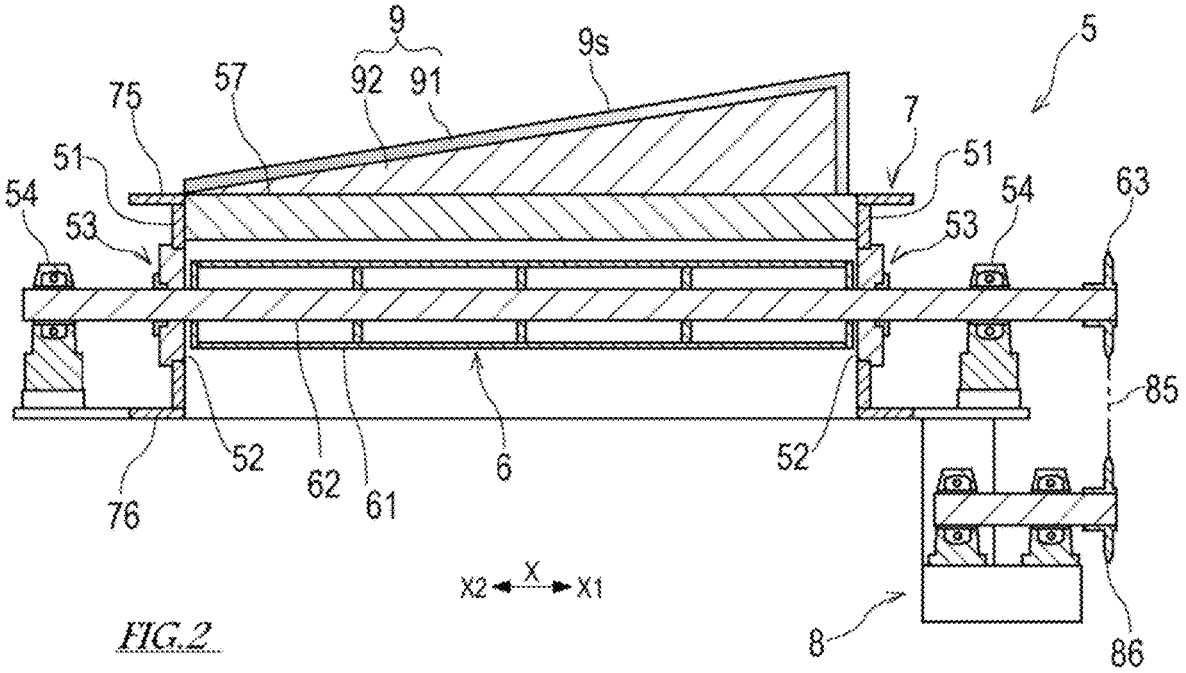
FIG. 2 is a cross-sectional view taken in the direction of arrows along II-II of FIG. 1.
Figure 3:
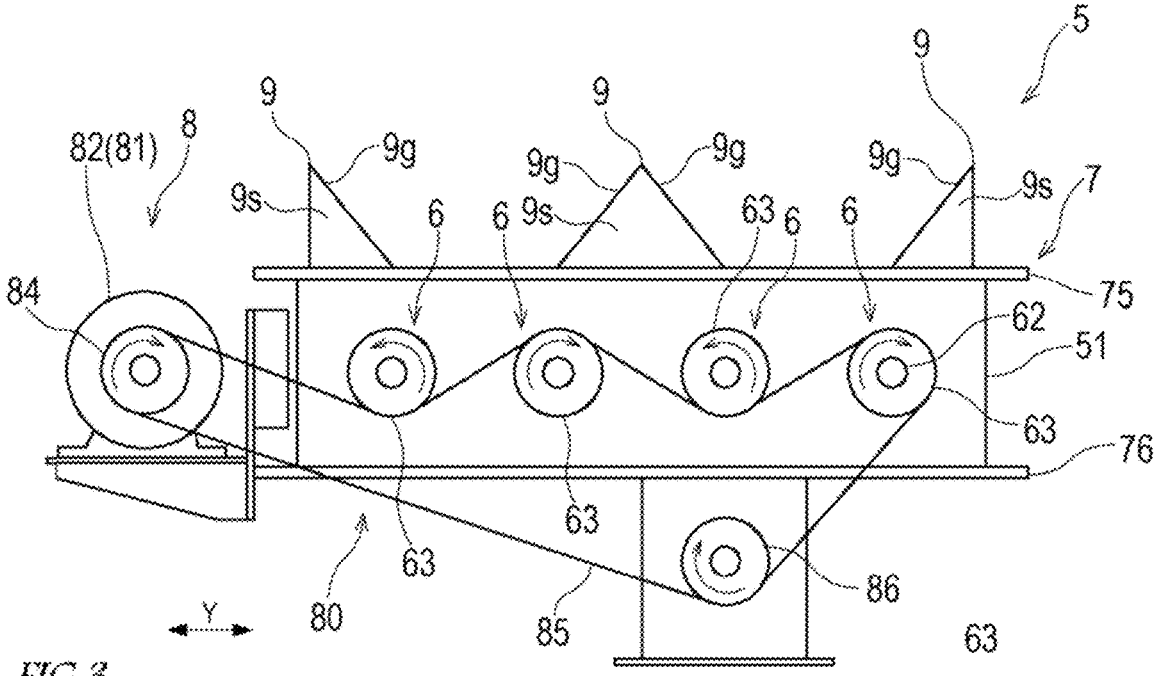
FIG. 3 is a view taken in the direction of arrows along of FIG. 1.
Figure 4:
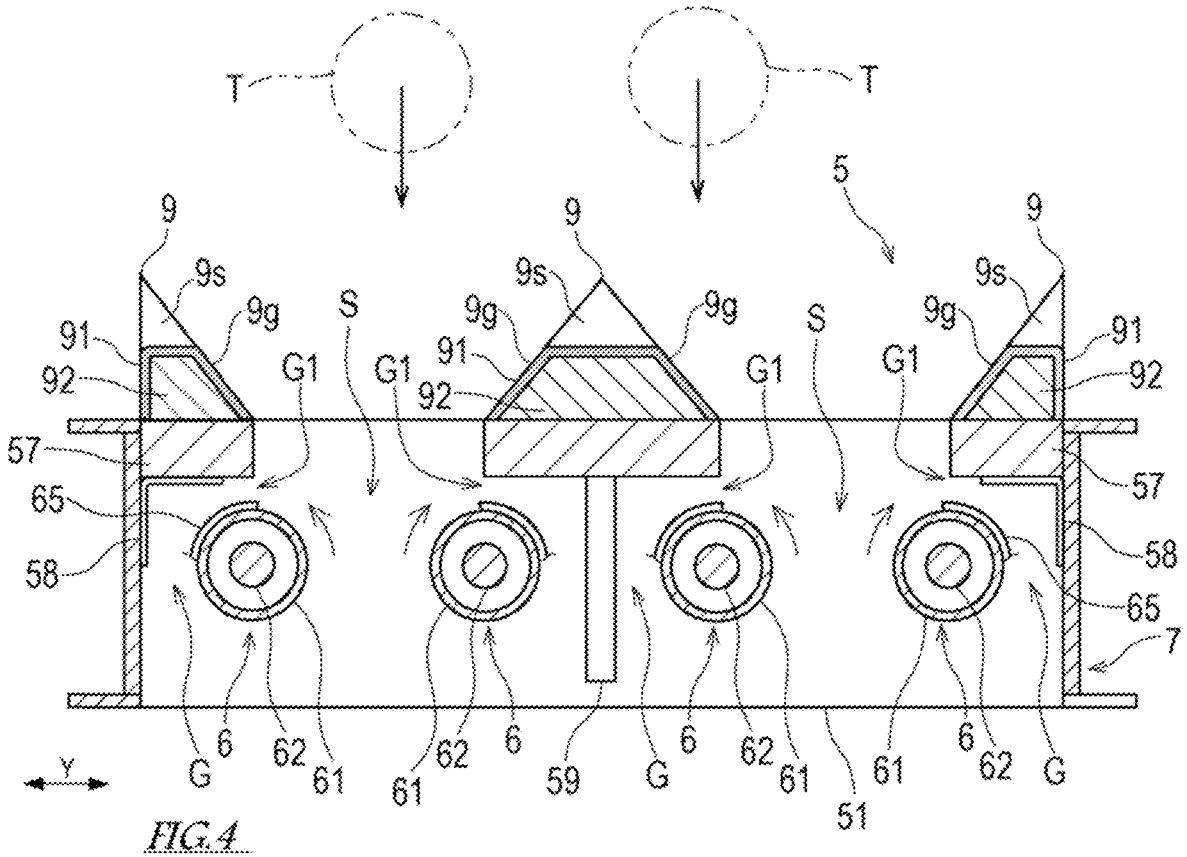
FIG. 4 is a cross-sectional view taken in the direction of arrows along Iv-Iv of FIG. 1.

First of all, a grizzly apparatus 5 according to an embodiment of the present invention will be described with reference to the drawings. FIG. 1 is a plan view of the grizzly apparatus 5 according to the embodiment of the present invention, in a state in which an extension direction of center axes of grizzly bars 6 is a horizontal direction. FIG. 2 is a cross-sectional view taken in the direction of arrows along II-II of FIG. 1. FIG. 3 is a cross-sectional view taken in the direction of arrows along of FIG. 1. FIG. 4 is a cross-sectional view taken in the direction of arrows along Iv-Iv of FIG. 1.

As shown in FIGS. 1 to 4, the grizzly apparatus 5 includes a plurality of rotary grizzly bars 6, a driving device 8 which rotates the plurality of grizzly bars 6, at least one guide 9 which guides a screening target object (object to be screened) T to a slit S which will be described later, and a frame 7 which supports components such as the grizzly bars 6 and at least one guide 9.

The frame 7 has a rectangular frame shape and includes flanges 75, 76 at an upper portion and a lower portion. The flanges 75, 76 are provided with a plurality of bolt holes (not shown). The plurality of bolt holes are used to mount the grizzly apparatus 5 to, for example, a hopper of a bottom ash discharge system which will be described later.

The frame 7 includes a pair of support walls 51 which are spaced apart from each other and face each other in a first direction X. The plurality of grizzly bars 6 are mounted on the pair of support walls 51 and extend between the pair of support walls 51. An extension direction of the center axis of each of the plurality of grizzly bars 6 is parallel to the first direction X.

Each of the support walls 51 is provided with through-holes 52 into which the grizzly bars 6 are inserted. For example, shaft seal devices 53 such as gland packings are provided to seal spaces formed between each of the grizzly bars 6 and the edges of the through-holes 52. The shaft seal devices 53 serve to permit the rotation of the grizzly bar 6 and inhibit flow or movement of the screening target object T, liquid and gases to inside and outside regions of the frame 7 through the through-holes 52.

The grizzly bars 6 inserted into the frame 7 in the above-described manner are insertable into and disengageable (detachable) from the frame 7. In a case where each of the grizzly bars 6 is detached from the frame 7, the grizzly bar 6 is moved in a direction parallel to the extension direction (first direction X) of the center axis, together with the shaft seal devices 53, and pulled out of the frame 7. In this way, each of the grizzly bars 6 can be independently detached from the frame 7, changed (replaced) or repaired.

The plurality of grizzly bars 6 are arranged at predetermined intervals in a second direction Y perpendicular to the first direction X. In the grizzly apparatus 5 shown, the extension direction (first direction X) of the center axes of the grizzly bars 6 is the horizontal direction. However, the grizzly apparatus 5 is used in a state in which the extension direction of the center axes of the grizzly bars 6 is inclined with respect to the horizontal direction. In other words, during use of the grizzly apparatus 5, there is a level difference in a vertical direction between the first end portions of the grizzly bars 6 and the second end portions of the grizzly bars 6. Hereinafter, for easier description, regarding the grizzly apparatus 5 during use, a side where the first end portions of the grizzly bars 6 in the first direction X, the first end portions being higher than the second end portions of the grizzly bars 6 in the first direction X, are located, will be referred to "upstream side X1", and a side opposite to the "upstream side X1" will be referred to as "downstream side X2."

In the present embodiment, in a case where two adjacent grizzly bars 6 form one pair of grizzly bars 6, the grizzly apparatus 5 includes two pairs of grizzly bars 6, which are four grizzly bars 6. However, the number the grizzly bars 6 is not limited to this. Between the grizzly bars 6 forming the pair, a slit S extending in the first direction X is formed by these grizzly bars 6. Between the two pairs of grizzly bars 6, and between the pair of grizzly bars 6 and the frame 7, gaps G in the second direction Y are formed. The dimension of the slit S in the second direction Y is set to a predetermined dimension corresponding to the screen opening, because the screening target object T is sorted out depending on the dimension. In contrast, the dimension of the gap G in the second direction Y may be set to any value so long as the adjacent grizzly bars 6 do not contact each other, or the outer peripheral surface of the roller 61 of the grizzly bar 6 and the frame 7 do not contact each other.

Each of the grizzly bars 6 includes the roller 61 with a tubular shape, which is accommodated inside the frame 7 and extends in the first direction X, and a rotary shaft 62 penetrating the center axis portion of the roller 61 in the first direction X, the roller 61 and the rotary shaft 62 being integrated. The both end portions of each of the rotary shafts 62 protrude in the first direction X from the frame 7, and are supported by bearings devices 54, respectively in such a way that each of the rotary shafts 62 is rotatable, in an outside region of the frame 7. The first end portion of each of the rotary shafts 62 is provided with a driven sprocket 63 which is rotatable together with the rotary shaft 62 (grizzly bar 6).

The driving device 8 includes a motor 81 which is a driving power source, a speed reduction unit 82 which adjusts rotational torque of the output of the motor 81, and a driving power transmission mechanism 80 of a chain type which transmits the output of the speed reduction unit 82 to each of the grizzly bars 6. As shown in FIG. 3 in detail, the driving power transmission mechanism 80 includes an input sprocket 84 provided at an output shaft 83 of the speed reduction unit 82, driven sprockets 63 provided at the grizzly bars 6, respectively, a rotational direction adjustment sprocket 86, and an endless chain 85 wrapped around the sprockets 84, 63, 86. Note that the configuration of the driving device 8 is not limited to the above, and the driving device 8 may include a speed reduction unit for coupling the rotary shafts 62 of the plurality of grizzly bars 6 to each other, and a motor which inputs rotational driving power to this speed reduction unit.

The driving device 8 rotates the grizzly bars 6 so that the screening target object T present in the slit S formed between the pair of grizzly bars 6 is pushed in an upward direction by the rotation of the pair of grizzly bars 6. In the present embodiment, each of the grizzly bars 6 is driven to rotate in a direction opposite to the rotational direction of its adjacent grizzly bar 6. For example, as shown in FIG. 3, the plurality of grizzly bars 6 are driven to rotate so that the grizzly bar 6 disposed at a rightmost end rotates in a forward direction (clockwise direction), the second grizzly bar 6 from the rightmost end rotates in a reverse direction (counterclockwise direction), the third grizzly bar 6 from the rightmost end rotates in the forward direction, and the fourth grizzly bar 6 from the rightmost end rotates in the reverse direction. By the rotation of the plurality of grizzly bars 6 described above, the slit S through which the screening target object T passes and the gap G through which the screening target object T does not pass alternately emerge between the adjacent grizzly bars 6. The slit S is formed by the peripheral surfaces rotating in the upward direction, of two grizzly bars 6. In the slit S, by the rotating grizzly bars 6, a force for pushing up the screening target object T is applied to the screening target object T. The gap G is formed by the peripheral surfaces rotating in the downward direction, of two grizzly bars 6. Also, the gap G is formed by the peripheral surface rotating in the downward direction, of one grizzly bar 6, and the frame 7.

Figure 5:
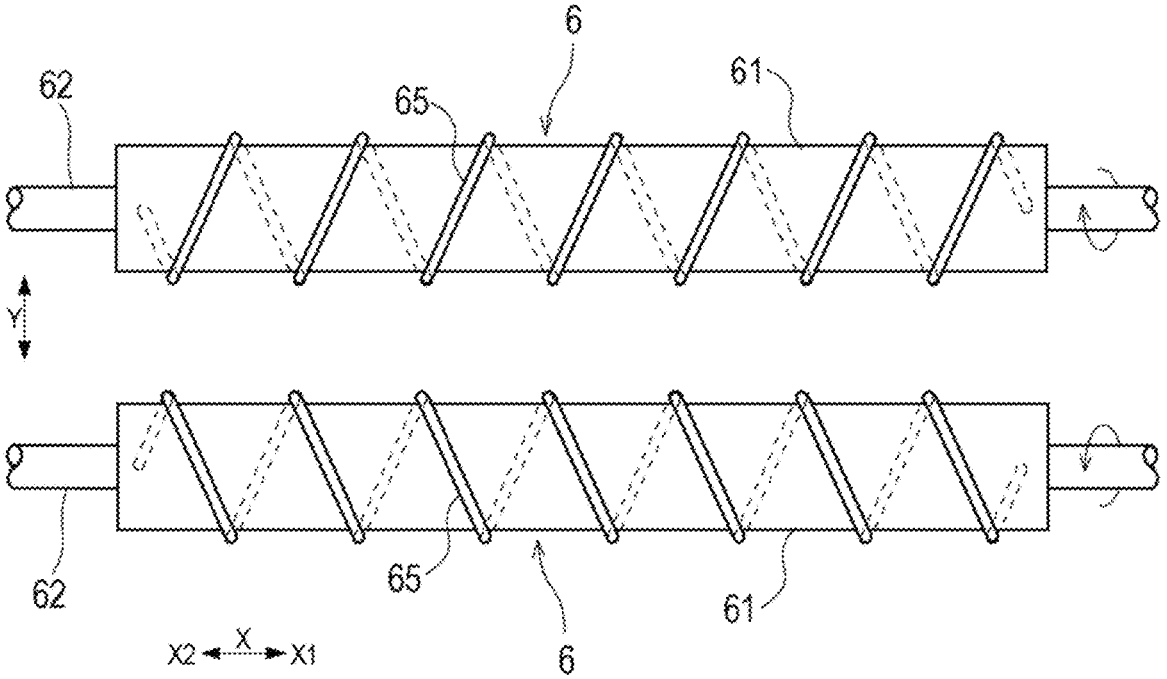
FIG. 5 is a plan view of a pair of grizzly bars.

FIG. 5 is a plan view of the pair of grizzly bars 6. As shown in FIG. 5, a spiral protruding part 65 is provided on the outer peripheral surface of the roller 61 of each of the grizzly bars 6 and advances in the first direction X (extension direction of the center axis). The rotational direction of each of the grizzly bars 6 conforms to a direction in which the spiral protruding part 65 provided on its outer peripheral surface is wound. For example, when viewed from the downstream side X2 in the first direction X, the winding direction of the spiral protruding part 65 is a rightwardly turning direction in the case of the grizzly bar 6 (6*a*) rotating in a forward direction, while the winding direction of the spiral protruding part 65 is a leftwardly turning direction in the case of the grizzly bar 6 (6*b*) rotating in a reverse direction. The protruding parts 65 provided on the outer peripheral surfaces of the rollers 61 acts on the screening target object T present in the slit S and more effectively push up the screening target object T by the rotation of the pair of grizzly bars 6. In addition, by the rotation of the pair of grizzly bars 6, movement of the screening target object T present in the slit S to the downstream side X2 is facilitated. Further, by the rotation of the pair of grizzly bars 6, a thermal load from a region that is above the grizzly apparatus 5 is reduced.

Figure 7A:
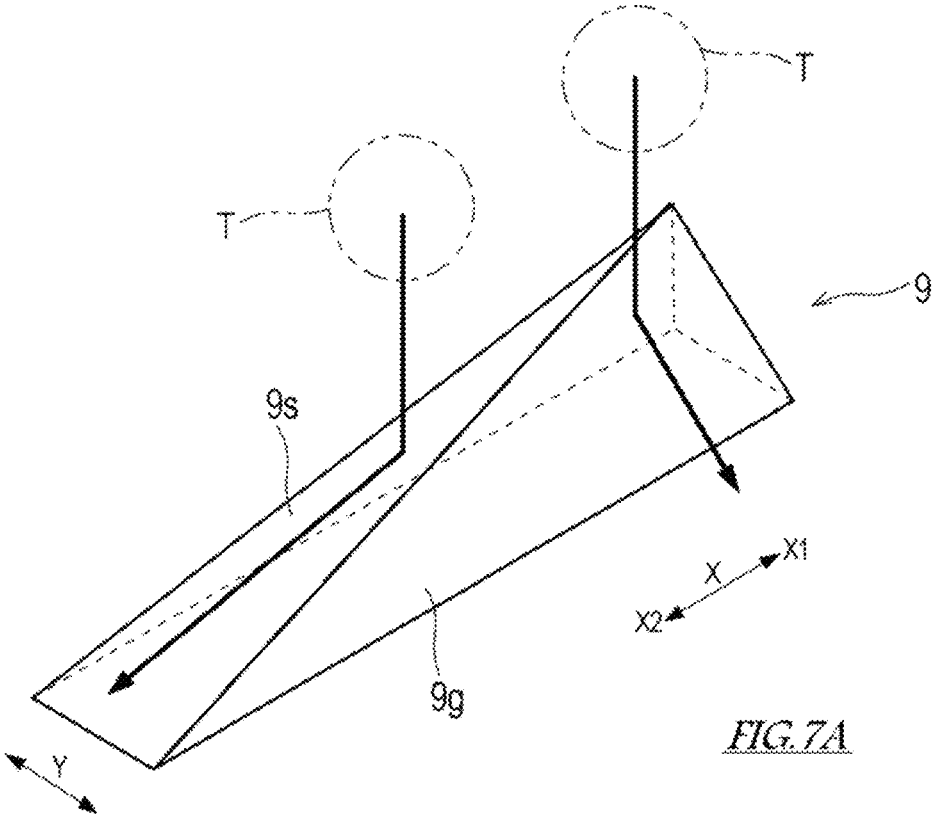
FIG. 7A is a perspective view of the guide.
Figure 7B:
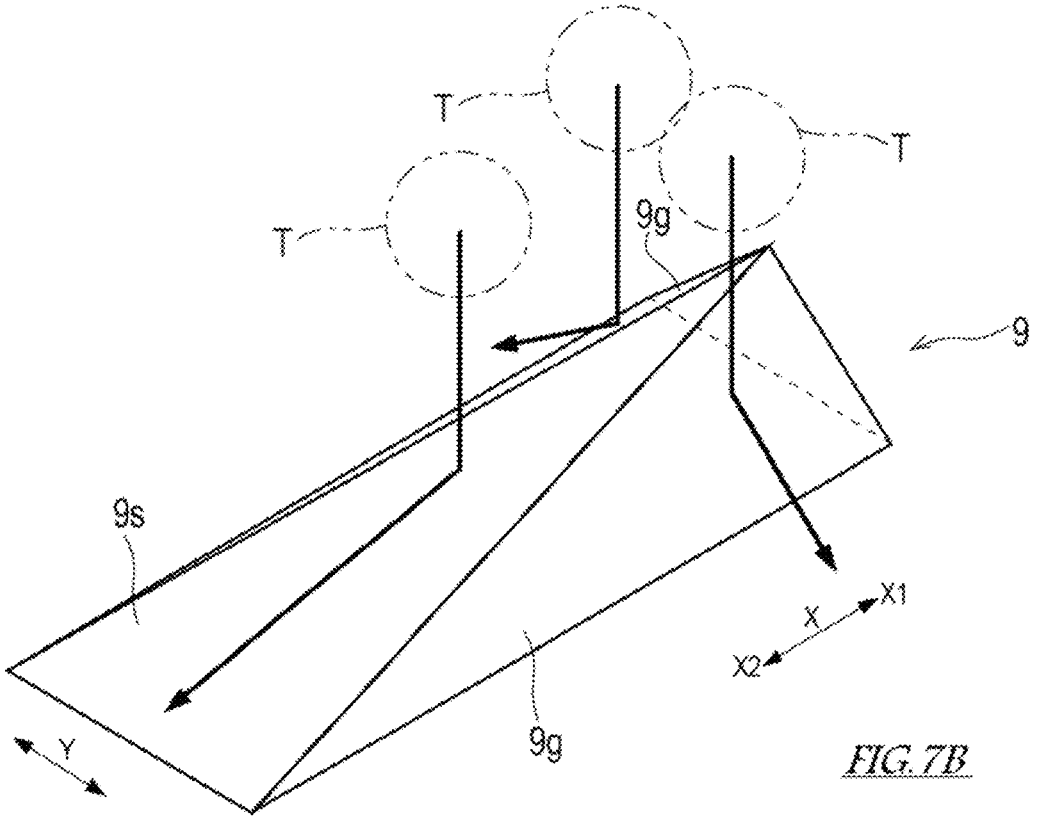
FIG. 7B is a perspective view of the guide.
Figure 7C:
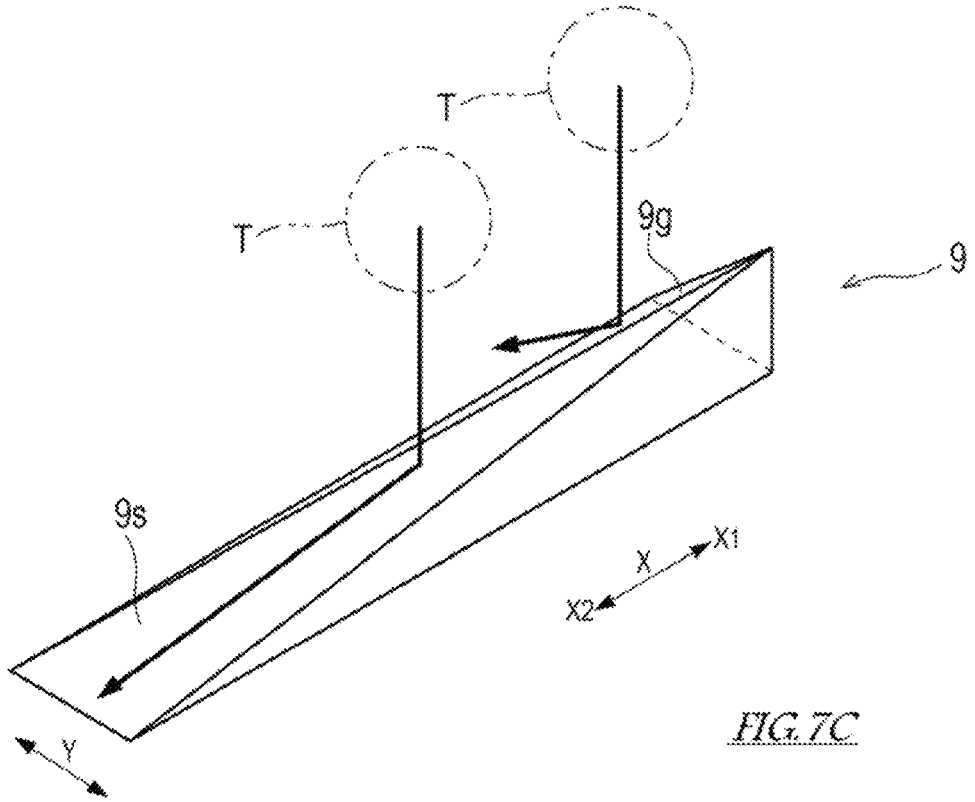
FIG. 7C is a perspective view of the guide.

At least one guide 9 is provided above the above-described plurality of grizzly bars 6. As shown in FIGS. 1, 2, 4, and 7A to 7C, the grizzly apparatus 5 of the present embodiment includes three guides 9 disposed at locations that are above the gaps G each of which is formed between the frame 7 and the grizzly bar 6 which are adjacent to each other in the second direction Y, and above the gap G formed between the grizzly bars 6 which are adjacent to each other in the second direction Y. FIGS. 7A to 7C are perspective views of the guides 9 according to the present embodiment. FIGS. 7A and 7C show the guides 9 each of which is disposed between the frame 7 and the grizzly bar 6 which are adjacent to each other in the second direction Y. FIG. 7B shows the guide 9 which is disposed above the gap G formed between the grizzly bars 6 which are adjacent to each other in the second direction Y.

The guide 9 includes an outer member 91 forming the outer shape (contour) of the guide 9, and a reinforcement member 92 provided in a space formed by the outer member 91.

Figure 6:
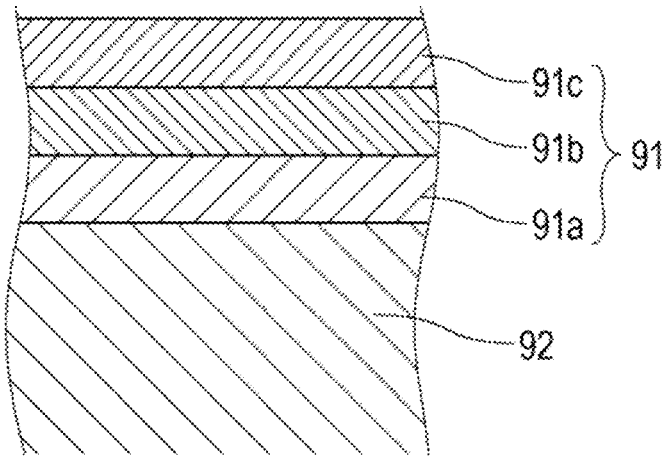
FIG. 6 is a cross-sectional view of a guide.

The outer member 91 forms the outer shape (except the bottom surface) of the guide 9. FIG. 6 is a cross-sectional view of the guide. As shown in FIG. 6, the outer member 91 according to the present embodiment has a layered structure including a base layer portion 91*a* made of a metal-made plate material, an intermediate layer portion 91*b* provided on the outer side of the base layer portion 91*a* and made of a heat insulating material, and an outermost layer portion 91*c* provided on the intermediate layer portion 91*b* and made of a fireproof (refractory) material. In a case where the grizzly apparatus 5 is used as a bottom ash discharge system 1 which will be described later, high-temperature bottom ash falls from a boiler furnace 10 onto the guide 9. The bottom ash raises the temperature of the outer surface of the guide 9. For this reason, the outermost layer portion 91*c* has a fireproof capability. To suppress deformation of the guide 9 caused by heat of the bottom ash falling onto the guide 9, the intermediate layer portion 91*b* of the outer member 91 has a heat insulating capability for insulating heat transferred to the base layer portion 91*a*.

The reinforcement member 92 is provided to allow the outer member 91 to have a stiffness for keeping its shape. In the present embodiment, the reinforcement member 92 is manufactured by pouring a material (filling material) having a heat resistance and an impact resistance, such as mortar, concrete, or a cured resin material with a heat resistance, into the space formed by the outer member 91, and by curing the filling material. In this way, the space formed by the outer member 91 of the guide 9 is filled with the filling material (reinforcement member 92) with a heat resistance and an impact resistance. In other words, the filling material fills the space without an airspace, and thus the guide 9 has a solid structure. In this structure, the guide 9 has a strength to withstand an impact so that the guide 9 is not deformed even when a substantial impact is applied to the guide 9 when the screening target object T is falling onto the guide 9. Note that, the reinforcement member 92 is not limited to the above-described filling material. For example, the reinforcement member 92 may be a frame, a block or the like disposed in the space formed by the outer member 91.

The guides 9 are mounted on beams 57, respectively, as members with a strength, which are provided at the upper portions of the frame 7, and extend in the first direction X between the upper portions of the frame 7. The guides 9 are supported by the beams 57, respectively. A location at which the beam 57 and the frame 7 are joined to each other is reinforced by use of a stay 58 with a L-shaped cross-section and a stay 59 with an I-shaped cross-section to improve a load resistance of the beam 57. In this structure, even in a case where an impact load is applied to the guide 9, the guide 9 and the beam 57 are supported by the frame 7 without flexure or deformation.

The guides 9 extend in the first direction X along the plurality of grizzly bars 6. Each of the guides 9 has a length in the first direction X which is almost equal to a distance between the pair of support walls 51 of the frame 7. Each of the guides 9 has a width in the second direction Y, from the end of the gap G to the center axis of the grizzly bar 6 forming the gap G. In this way, each of the guides 9 covers from above a region from the end of the gap G to the center axis of the grizzly bar 6 forming the gap G.

More specifically, the guide 9 which covers the gap G formed between the pair of grizzly bars 6 and the frame 7 has a width in the second direction Y, from the inner side of the frame 7 to a location that is substantially right above the center axis of one of the pair of grizzly bars 6 which is closer to the frame 7. The guide 9 which covers the gap G formed between the two pair of grizzly bars 6 has a width in the second direction Y, from a location that is substantially right above the center axis of one of the grizzly bars 6 forming this gap G to a location that is substantially right above the center axis of the other of the grizzly bars 6 forming this gap G.

Each of the guides 9 with the above-described configuration can inhibit entry of the screening target object T into the gap G in which the screening target object T may be stuck, and guide the screening target object T falling toward the gap G to the slit S. In addition, the guides 9 are disposed above the grizzly bars 6 in such a way that the guides 9 partially overlap with the grizzly bars 6 when viewed from above (in a plan view). Therefore, the large mass (lump) mixed in the screening target object T and falling down collides with (hits) the guide 9 with a strength to withstand an impact before it collides with the grizzly bar 6. In this way, the grizzly bars 6 are protected by the guides 9 so that the large masses falling down do not collide with (hit) the grizzly bars 6.

Each of the beams 57 supporting the guides 9 has a shape in which the beam 57 substantially overlaps with the guide 9 in a vertical direction. The beam 57 also has a width in the second direction Y, from the end of the gap G to the center axis of the grizzly bar 6 forming the gap G. In this structure, in a region that is above the center axis of each of the grizzly bars 6, a constricted (narrowed) space G1 of the gap is formed between the beam 57 and the grizzly bar 6. The vertical dimension of this constricted (narrowed) space G1 is set so that only the screening target object T which is sufficiently small can pass through the gap G without clogging. The constricted spaces G1 can inhibit entry of the screening target object T rotating with the grizzly bars 6 into the gaps G.

Each of the guides 9 has at least one guide surface 9*g* to guide the screening target object T having fallen onto the guide 9 to the slit S. The guide surface 9*g* is inclined with respect to the second direction Y in such a way that the guide surface 9*g* descends as it advances in the second direction Y toward the slit S. A central angle formed between the guide surface 9*g* of the guide 9 and the second direction Y is an acute angle which is less than 90 degrees. The screening target object T having fallen onto the guide 9 rolls over the guide 9 along the inclined guide surface 9*g*, by a gravitational force. In this way, the screening target object T is smoothly guided to the slit S located in the second direction Y relative to the guide 9.

Further, the guide 9 has at least one inclined surface 9*s* to facilitate movement of the screening target object T having fallen onto the guide 9 to the downstream side X2 in the first direction X. The inclined surface 9*s* is inclined with respect to the first direction X in such a way that the inclined surface 9*s* descends as it advances to the downstream side X2 in the first direction X. The screening target object T having fallen onto the guide 9 rolls over the guide 9 along the inclined surface 9*s*, by a gravitational force. In this way, movement of the screening target object T to the downstream side X2 in the first direction X is facilitated. By the function of this inclined surface 9*s*, the screening target object T and fine particles of the screening target object T are delivered to the downstream side X2 in the first direction X without remaining unmoving on the surface of the guide 9.

The guide 9 having the inclined surface 9*s* as described above is inclined with respect to the first direction X in such a way that a part of or all of its ridge line descends as it advances to the downstream side X2 in the first direction X. As defined herein, the "ridge line" of the guide 9 is a line segment connecting in the first direction X the bottom surface of the guide 9 to a highest point of the guide 9, in the outer shape of the guide 9. The bottom surface of the guide 9 is a flat surface parallel to the first direction X.

In the grizzly apparatus 5 during use, the ridge line of the guide 9 is inclined with respect to a horizontal direction at an angle larger than an angle at which the center axis of the grizzly bar 6 is inclined with respect to the horizontal direction. In other words, the ridge line of the guide 9 is inclined more steeply than the center axis of the grizzly bar 6.

Since the ridge line of each of the guides 9 is inclined with respect to the first direction X and its inclination is adjusted, the grizzly apparatus 5 can have a proper inclination with respect to the horizontal direction to allow the screening target object T to smoothly roll over the upper surface of the grizzly apparatus 5. In other words, the guides 9 can provide the grizzly apparatus 5 with a necessary inclination while reducing the inclination of the grizzly bars 6 with respect to the horizontal direction or irrespective of the inclination of the grizzly bars 6 with respect to the horizontal direction.

In the present embodiment, the guide 9 has a pyramid shape in which an end portion on the upstream side X1 in the first direction X is an apex.

Specifically, as shown in FIGS. 1 and 7B, the guide 9 disposed above the gap G between the grizzly bars 6 which are adjacent to each other in the second direction Y has a quadrangular pyramid shape in which a bottom surface and an end surface on the upstream side X1 in the first direction X are perpendicular to each other and an end portion on the upstream side X1 in the first direction X is an apex. This guide 9 has two guide surfaces 9*g* inclined with respect to the second direction Y in such a way that the guide surfaces 9*g* descend as they advance in the second direction Y toward the slit S, and one inclined surface 9*s* inclined with respect to the first direction X in such a way that the inclined surface 9*c* descends as it advances to the downstream side X2 in the first direction X.

As shown in FIGS. 1, 7A and 7C, the guides 9 each of which is disposed above the gap G formed between the frame 7 and the grizzly bar 6 which are adjacent to each other in the second direction Y has a shape in which the guide 9 with the above-described quadrangular pyramid shape is sectioned along a direction parallel to the first direction X, at a center in the second direction Y. Each of these guides 9 has one guide surface 9*g* and one inclined surface 9*s*.

Figure 8:
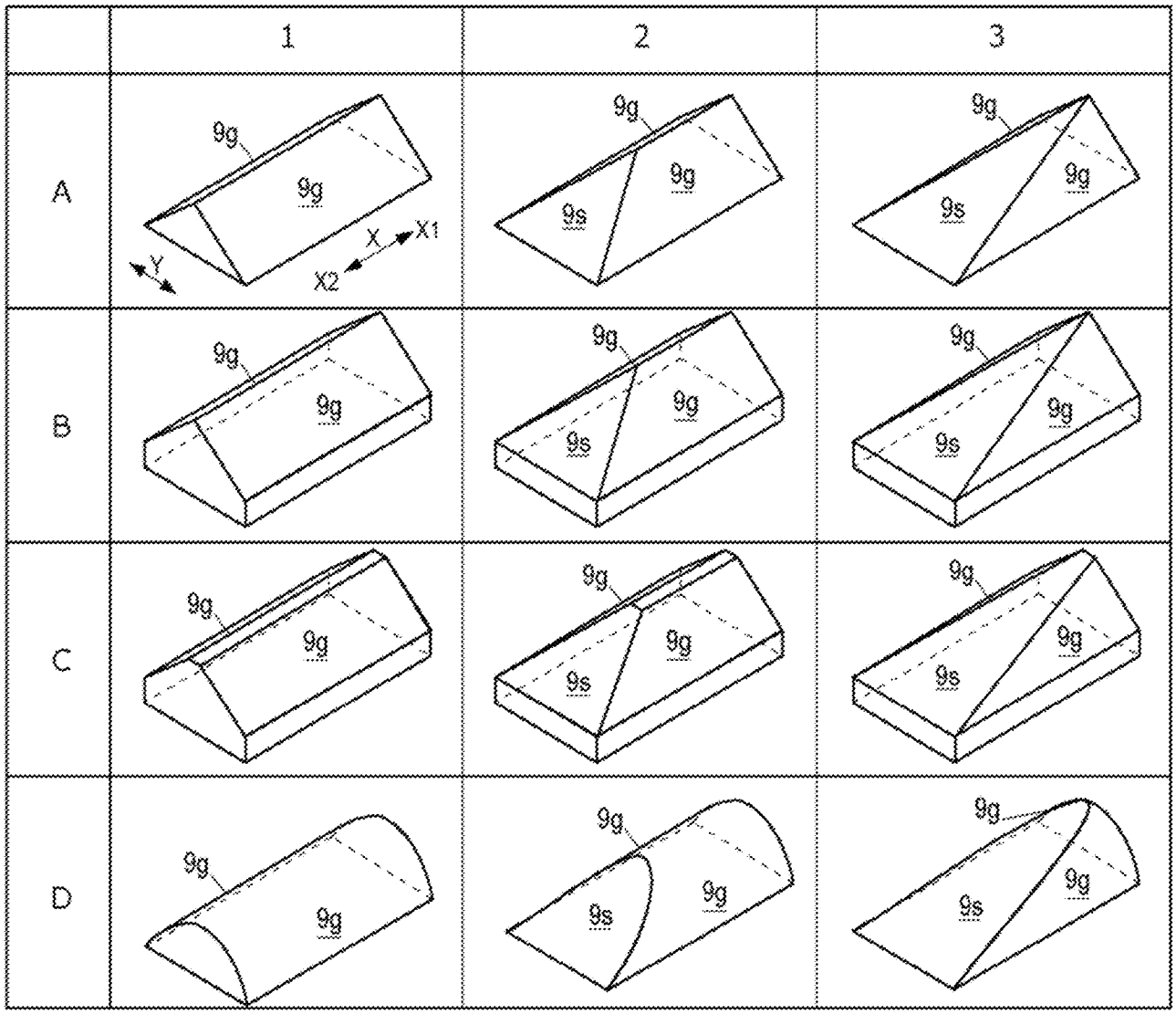
FIG. 8 is a table showing variations of the guide.

As described above, each of the guides 9 has, for example, a function of covering the gap G from above to inhibit entry of the screening target object T into the gap G, a function of guiding the screening target object T to the slit S so that the screening target object T smoothly moves to the slit S, and a function of protecting the grizzly bar 6 from the large mass mixed in the screening target object T and falling down. The shapes of the guides 9 are not limited to those of the present embodiment so long as the guides 9 have the above functions. For example, the shapes of the guides 9 may be selected from the shapes shown in a table of FIG. 8, containing variations of the guides 9. FIG. 8 shows the shapes of the guide 9 disposed above the gap G formed between the grizzly bars 6 which are adjacent to each other in the second direction Y. If these shapes are sectioned along a direction parallel to the first direction X at a center in the second direction Y, the shapes of the guide 9 disposed above the gap G formed between the frame 7 and the grizzly bar 6 which are adjacent to each other in the second direction Y can be obtained.

Each of the guides shown in first to third columns of A row of FIG. 8 has a shape in which an end surface on the upstream side X1 in the first direction X has a triangular shape and a bottom surface and the end surface on the upstream side X1 in the first direction X are perpendicular to each other. The guide in the first column of the A row has a cross-sectional shape which is constant in the first direction X, and has two guide surfaces 9*g*. The guide in the second column of the A row has a shape in which a corner portion including almost a half of a ridge line which is on the downstream side X2 in the first direction X and an end surface on the downstream side X2 in the first direction X is removed from the guide shown in the first column of the A row. This guide has two guide surfaces 9*g* and one inclined surface 9*s*. The guide in the third column of the A row has a quadrangular pyramid shape in which a corner portion including a whole ridge line in the first direction X and an end surface on the downstream side X2 in the first direction X is removed from the guide shown in the first column of the A row. This guide has two guide surfaces 9*g* and one inclined surface 9*s*.

Each of the guides shown in first to third columns of B row of FIG. 8 has a shape in which an end surface on the upstream side X1 in the first direction X has a pentagon (home base) shape and a bottom surface and the end surface on the upstream side X1 in the first direction X are perpendicular to each other. The guide in the first column of the B row has a cross-sectional shape which is constant in the first direction X, and has two guide surfaces 9*g*. The guide in the second column of the B row has a shape in which a corner portion including almost a half of a ridge line which is on the downstream side X2 in the first direction X and an end surface on the downstream side X2 in the first direction X is removed from the guide shown in the first column of the B row. This guide has two guide surfaces 9*g* and one inclined surface 9*s*. The guide in the third column of the B row has a shape in which a corner portion including a whole ridge line in the first direction X and an end surface on the downstream side X2 in the first direction X is removed from the guide shown in the first column of the B row, and its upper portion has a quadrangular pyramid shape. The guide in the third column of the B row has two guide surfaces 9*g* and one inclined surface 9*s*.

Each of the guides shown in first to third columns of C row of FIG. 8 has a shape in which a ridge line portion is removed along a direction parallel to a bottom surface, from the corresponding one of the guides shown in the first to third columns of the B row. The guide in the first column of the C row has two guide surfaces 9*g* inclined with respect to the second direction Y. Each of the guides in the second to third columns of the C row has two guide surfaces 9*g* and one inclined surface 9*s*.

Each of the guides shown in first to third columns of D row of FIG. 8 has a shape in which an end surface on the upstream side X1 in the first direction X has a semicircular shape, and a bottom surface and the end surface on the upstream side X1 in the first direction X are perpendicular to each other. The guide in the first column of the D row has a cross-sectional shape which is constant in the first direction X, and has two guide surfaces 9*g*. The guides shown in the D row have the guide surfaces 9*g* which are curved surfaces. The guides shown in the D row do not have clear ridge lines. A surface on one side in the second direction Y and a surface on the other side in the second direction Y, with a top portion located between these surfaces, are the guide surfaces 9*g*, respectively. The guide in the second column of the D row has a shape in which a corner portion including an almost a half of a top portion which is on the downstream side X2 in the first direction X and an end surface on the downstream side X2 in the first direction X is removed from the guide shown in the first column of the D row. This guide has two guide surfaces 9*g* and one inclined surface 9*s*. The guide in the third column of the D row has a shape in which a corner portion including a whole top portion in the first direction X and an end surface on the downstream side X2 in the first direction X is removed from the guide shown in the first column of the D row. This guide has two guide surfaces 9*g* and one inclined surface 9*s*.

[Bottom Ash Discharge System]

Figure 9:
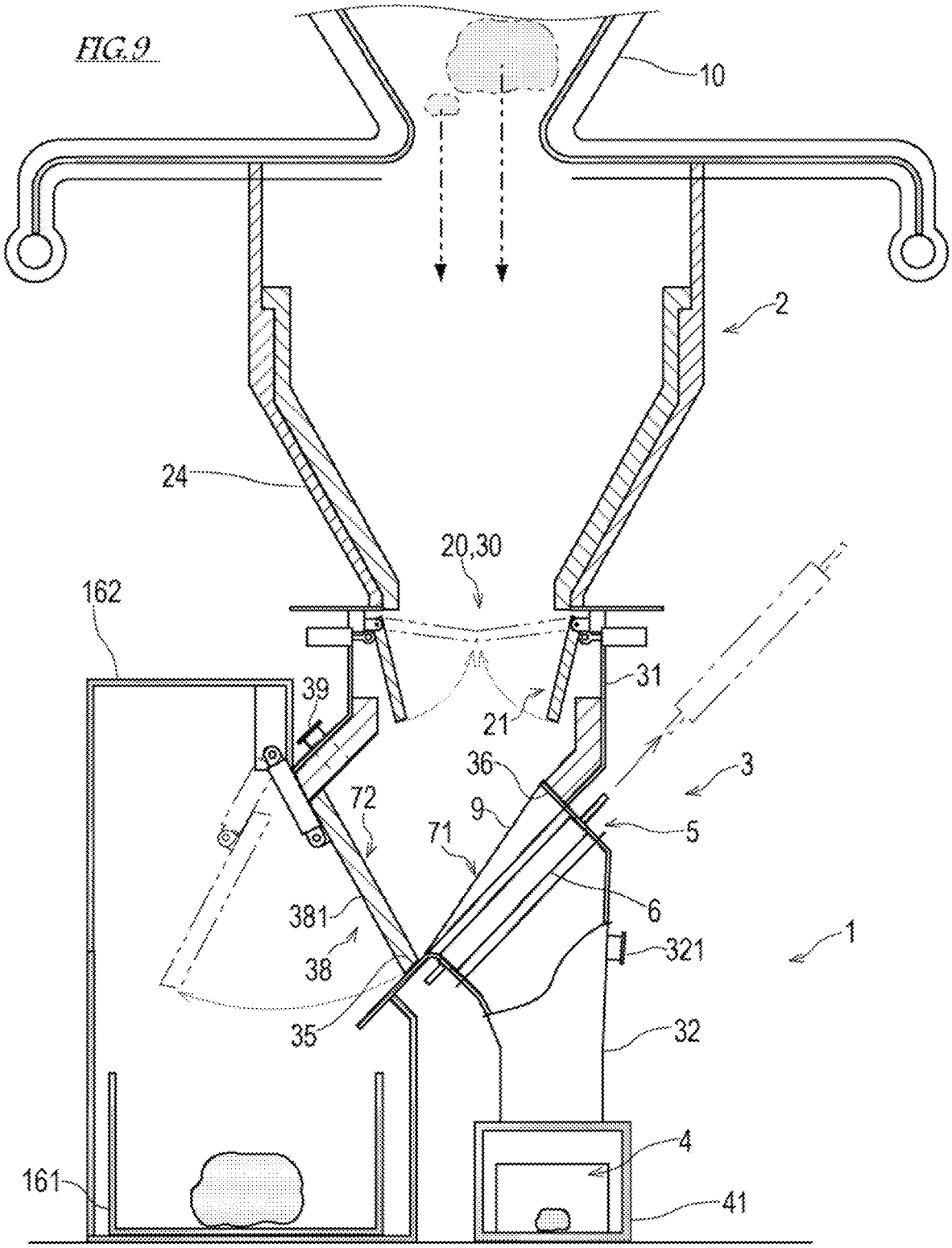
FIG. 9 is a view showing the schematic configuration of a bottom ash discharge system according to the embodiment of the present invention.

Next, the bottom ash discharge system 1 which discharges the bottom ash from the furnace bottom of the boiler furnace 10 and uses the above-described grizzly apparatus 5 will be described. FIG. 9 is a view showing the schematic configuration of the bottom ash discharge system 1 according to the embodiment of the present invention.

The bottom ash discharge system 1 includes a hopper 2, a separation device 3, and a conveyor device 4, from an upstream side to a downstream side along a flow of movement of the bottom ash.

The hopper 2 is configured to receive the bottom ash falling from the boiler furnace 10 to the hopper 2, and to discharge the bottom ash to a downstream region (specifically, the separation device 3). The hopper 2 is disposed below the boiler furnace 10, and coupled to the furnace bottom of the boiler furnace 10. The hopper 2 includes one or a plurality of cone sections 24 corresponding to a length in the lengthwise direction of the boiler furnace 10. A feeding valve device 21 is disposed at a discharge port 20 of each cone section 24 or below the discharge port 20. The feeding valve device 21 is configured to perform switching between feeding of the bottom ash to the separation device 3 and stop of feeding of the bottom ash to the separation device 3, or adjust the amount (volume) of the bottom ash to be fed to the separation device 3.

The separation device 3 is configured to receive the bottom ash discharged from the hopper 2, to separate the large mass (huge lump) with a size larger than a predetermined size, from a main stream of the bottom ash, to collect large masses, and to discharge the remaining bottom ash to a downstream region (specifically, conveyor device 4).

An entrance 30 of a housing 31 defining the passage of the bottom ash inside the separation device 3 is connected to the discharge port 20 of the cone section(s) 24 of the hopper 2. The housing 31 has a hopper shape (funnel shape) with a cross-sectional area reduced in a downward direction. A fireproof (refractory) material 313 with an impact resistance is bonded to the inner portion of the housing 31.

The housing 31 is provided with the entrance 30 through which the bottom ash moves into the housing 31, an exit 36 through which the bottom ash moves out of the housing 31 toward the conveyor device 4, and a discharge port 35 through which the large ash mass is discharged, the entrance 30 being provided at a top portion of the housing 31, and the exit 36 and the discharge port 35 being provided at a bottom portion of the housing 31. The housing 31 includes a first bottom portion 71 which is inclined with respect to a horizontal direction, and a second bottom portion 72 which is inclined with respect to the horizontal direction, in a direction opposite to the inclination direction of the first bottom portion 71. The first bottom portion 71 and the second bottom portion 72 cross each other at the bottom portion of the housing 31. In this structure, the bottom portion of the housing 31 has a shape which is narrowed at its bottom. The exit 36 of the housing 31 opens in the first bottom portion 71 of the housing 31. The discharge port 35 of the housing 31 opens in the second bottom portion 72 of the housing 31. Each of a perpendicular line of an opening plane of the exit 36 and a perpendicular line of an opening plane of the discharge port 35 is inclined with respect to a vertical direction. The inclinations of these perpendicular lines include horizontal components with directions that are opposite to each other. In the above-described structure, the opening plane is defined as a virtual plane formed by an opening edge.

An entrance of a chute 32 is connected to the exit 36 of the housing 31 via the grizzly apparatus 5. More specifically, the flanges 75 (see FIG. 2) of the flame 7 of the grizzly apparatus 5 are fastened to the opening edge of the exit 36 of the housing 31 by use of bolts, and the opening edge of the entrance of the chute 32 is fastened to the flanges 76 (see FIG. 2) of the frame 7. The exit of the chute 32 is connected to a casing 41 of the conveyor device 4. The frame 7 of the grizzly apparatus 5 and the chute 32 which are coupled to the housing 31 as described above form a passage to feed the bottom ash having moved out of the exit 36 of the housing 31 to the conveyor device 4.

The grizzly apparatus 5 is mounted on the housing 31 in a state in which the grizzly bars 6 are inclined at an angle of 35 to 55 degrees with respect to the horizontal direction. The guides 9 of the grizzly apparatus 5 enter the inner region of the housing 31 and form a part of the first bottom portion 71. The ridge lines of the guides 9 are inclined with respect to the horizontal direction, at an angle of 45 to 65 degrees larger than an angle at which the grizzly bars 6 are inclined with respect to the horizontal direction.

During maintenance work for the grizzly apparatus 5, in a state in which the frame 7 is joined to the housing 31 and the chute 32, each of the grizzly bars 6 can be independently detached from the frame 7, and the detached grizzly bar 6 can be repaired or changed into new one. In this case, the grizzly bar 6 and the shaft seal device 53 are moved in the first direction X with respect to the frame 7. As described above, by reducing the inclination of the grizzly bars 6 with respect to the horizontal direction, it becomes possible to reduce a vertical level to which the grizzly bars 6 are raised during the maintenance work.

The housing 31 is provided with an inspection window 39 on a wall facing the exit 36. The chute 32 is provided with an inspection window 321 on a wall facing the grizzly apparatus 5. The inspection windows 39, 321 can be opened. In a case where the bottom ash remains unmoving in the grizzly apparatus 5 (the bottom ash clogs the grizzly apparatus 5), this bottom ash can be picked and crushed through at least one of these inspection windows 39, 321.

The discharge port 35 of the housing 31 is located on an extension line of the guides 9 of the grizzly apparatus 5. The lowermost position of the discharge port 35 is as high as or lower than the lowermost position (the end portions of the guides 9 on the downstream side X2 in the first direction X shown in FIG. 1) of the guides 9 of the grizzly apparatus 5, and the lowermost position of the guides 9 is smoothly continuous with the second bottom portion 72 of the housing 31. In this structure, the large ash mass having rolled over the guide 9 can be smoothly moved to the discharge port 35.

The discharge port 35 of the housing 31 is provided with a discharge valve device 38 which opens and closes the discharge port 35. In the present embodiment, the discharge valve device 38 includes a flap 381 which is able to close the discharge port 35, a driving mechanism 382 for driving the flap 381, and a controller 383. The driving mechanism 382 is, for example, a hydraulic cylinder.

The discharge port 35 is provided with an enclosure 162 enclosing the discharge port 35. In a state in which the discharge port 35 is opened, the interior of the enclosure 162 and the interior of the housing 31 of the separation device 3 are in communication with each other. Inside the enclosure 162, a container 161 is provided below the discharge port 35 to accommodate therein the large ash mass having fallen through the discharge port 35.

Next, the function of the bottom ash discharge system 1 with the above-described configuration will be described.

The bottom ash having fallen from the furnace bottom of the boiler furnace 10 onto the hopper 2 is fed to the inside of the housing 31 of the separation device 3 through the hopper 2. The bottom ash having been fed to the inside of the housing 31 falls onto the upper surface of the grizzly apparatus 5 by a gravitational force.

Of the bottom ash having fallen onto the grizzly apparatus 5, ash mass with a size smaller than the width of the slit S directly falls to the slit S, or is guided by the guide 9 to the slit S and reaches the slit S. The ash mass passes through the slit S and then is fed to the conveyor device 4 through the chute 32.

In contrast, of the bottom ash having fallen onto the grizzly apparatus 5, the large ash mass with a size larger than the width of the slit S rolls over the guide 9 and/or the grizzly bar 6 and reaches the discharge port 35. When the discharge valve device 38 opens the discharge port 35 which is closed in a steady state, the large ash mass is discharged from the housing 31 through the discharge port 35, falls onto the inside of the container 161 and is accommodated in the container 161.

As described above, in the bottom ash discharge system 1, the separation device 3 separates the large ash mass (large ash lump) from the main stream of the bottom ash, and the separated large ash masses are collected. In some cases, a huge ash mass may fall onto the grizzly apparatus 5 included in the separation device 3. However, the guide 9 can prevent a situation in which the huge ash mass directly hits the grizzly bar 6. The guide 9 with a solid structure has a strength to withstand an impact generated by a direct hit of the huge ash mass. The guide 9 is not deformed or damaged and its function is maintained even when the huge ash mass directly hits the guide 9. In this way, the grizzly apparatus 5 is able to withstand an impact generated by the large ash mass falling from the boiler furnace 10 onto the grizzly apparatus 5, and to separate the large ash mass from the stream of the bottom ash. Therefore, the above-described grizzly apparatus 5 is suitably used as a separating device which separates the large ash mass from the stream of the bottom ash in the above-described bottom ash discharge system 1.

The preferred embodiment (and modified example) of the present invention have been described above. Numerous modifications and alternative embodiments of the present invention will be apparent to those skilled in the art in view of the foregoing description. Accordingly, the description is to be construed as illustrative only, and is provided for the purpose of teaching those skilled in the art the best mode of conveying out the invention. The details of the structure and/or function may be varied substantially without departing from the spirit of the invention.

REFERENCE SIGNS LIST

1 bottom ash discharge system
2 hopper
3 separation device
4 conveyor device
5 grizzly apparatus
6 grizzly bar
7 frame
8 driving device
9 guide

9*g* guide surface
9*s* inclined surface
10 boiler furnace
20 discharge port
31 housing
32 chute
35 discharge port
36 exit
38 discharge valve device
53 shaft seal device
57 beam
61 roller
62 rotary shaft
65 protruding part
91 outer member
92 reinforcement member
G gap
S slit
T screening target object
X first direction
X1 upstream side
X2 downstream side
Y second direction

The invention claimed is:

1. A grizzly apparatus comprising:

a plurality of grizzly bars each extending in an extension direction such that a center axis of each of the plurality of grizzly bars is parallel to a first direction, the plurality of grizzly bars being arranged at predetermined intervals in a second direction perpendicular to the first direction, each of the plurality of grizzly bars being configured to rotate in a direction opposite to a direction of rotation of an adjacent grizzly bar of the plurality of grizzly bars, a slit and a gap alternately being formed between the plurality of grizzly bars based on the respectively different directions of rotation of the plurality of grizzly bars, a screening target object passing through the slit and not passing through the gap, the slit being formed between peripheral surfaces rotating in an upward direction of the adjacent grizzly bars; and at least one guide disposed above the plurality of grizzly bars in a vertical direction of the grizzly apparatus and extending in the first direction, the at least one guide including (i) an outer portion forming an outer shape of the at least one guide and forming a chamber within the at least one guide, and (ii) a reinforcement provided in the chamber formed by the outer portion to entirely fill an interior of the chamber to form the at least one guide as entirely solid, the reinforcement reinforcing the outer portion to provide a stiffness to the outer portion to maintain the outer shape, the at least one guide having at least one guide surface inclined with respect to the second direction such that the at least one guide surface declines in the vertical direction as the at least one guide surface extends in the second direction toward the slit, the at least one guide surface guiding the screening target object along the at least one guide to the slit.

2. The grizzly apparatus according to claim 1, wherein the reinforcement includes a filling material filled in the space formed by the outer portion.

3. The grizzly apparatus according to claim 1, wherein the outer portion includes an outermost layer portion made of a fireproof material.

4. The grizzly apparatus according to claim 3, wherein the outer portion includes an intermediate layer portion made of a heat insulating material.

5. The grizzly apparatus according to claim 1, wherein the at least one guide has a ridge line that is inclined with respect to the first direction such that the ridge line declines in the vertical direction as the ridge line extends to a first side of the at least one guide in the first direction.

6. The grizzly apparatus according to claim 1, wherein the at least one guide has at least one inclined surface that is inclined with respect to the first direction such that the inclined surface declines in the vertical direction as the inclined surface extends to a first side of the at least one guide in the first direction.

7. The grizzly apparatus according to claim 5, wherein the at least one guide has a pyramid shape in which an end portion on a second side in the first direction is an apex.

8. The grizzly apparatus according to claim 1, wherein a width of each of the plurality of guides extends in the second direction from an end of the gap to the center axis of each grizzly bar forming the gap.

9. The grizzly apparatus according to claim 1, wherein at least one of the plurality of grizzly bars includes a roller having an outer peripheral surface formed with a spiral protruding part which advances in the first direction and is wound around the outer peripheral surface in the same direction as a rotation direction of the at least one grizzly bar.

10. The grizzly apparatus according to claim 1, further comprising:

a frame into which the plurality of grizzly bars are inserted; and a plurality of shaft seal devices each is configured to seal a space formed between the frame and corresponding one of the plurality of grizzly bars, wherein at least one of the plurality of grizzly bars is insertable into and disengageable from the frame in the first direction together with a corresponding one of the plurality of shaft seal devices.

11. The grizzly apparatus according to claim 1, wherein:

the at least one guide is supported by a beam provided at a frame at a location that is above the plurality of grizzly bars, and a width of the beam in the second direction extends from an end of the gap to the center axis of each grizzly bar forming the gap.

12. A bottom ash discharge system configured to discharge bottom ash having fallen onto a furnace bottom of a furnace, from the furnace bottom to an outside region, the bottom ash discharge system comprising:

a housing including (i) an entrance through which the bottom ash is fed to an inside of the housing, (ii) a discharge port through which a large mass of the bottom ash having a size larger than a predetermined size is discharged, and (iii) an exit through which the bottom ash containing no large mass is discharged; and the grizzly apparatus recited in claim 1, the grizzly apparatus being provided in a passage of the bottom ash from the entrance of the housing to the exit of the housing, and the grizzly apparatus is configured to separate the large mass from the bottom ash.

* * * * *